US006168677B1

(12) United States Patent
Warren

(10) Patent No.: US 6,168,677 B1
(45) Date of Patent: Jan. 2, 2001

(54) MINIMUM SIGNATURE ISOCYANATE CURED PROPELLANTS CONTAINING BISMUTH COMPOUNDS AS BALLISTIC MODIFIERS

(75) Inventor: Larry C. Warren, Huntsville, AL (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/393,066

(22) Filed: Sep. 2, 1999

(51) Int. Cl.[7] ..... C06B 45/10
(52) U.S. Cl. ..... 149/19.4; 149/19.92
(58) Field of Search ..... 149/19.4, 92

(56) References Cited

U.S. PATENT DOCUMENTS

| | | | | |
|---|---|---|---|---|
| H1341 | * | 8/1994 | Hughes et al. | 149/19.4 |
| 3,924,405 | * | 12/1975 | Cohen et al. | 60/219 |
| 4,216,039 | * | 8/1980 | Pierce | 149/19.4 |
| 4,555,277 | * | 11/1985 | Scribner | 149/19.4 |
| 4,707,540 | * | 11/1987 | Manser et al. | 528/417 |
| 4,764,586 | * | 8/1988 | Manser et al. | 528/362 |
| 4,775,432 | * | 10/1988 | Kolonko et al. | 149/19.4 |
| 5,398,612 | * | 3/1995 | Graham et al. | 102/287 |
| 5,500,061 | * | 3/1996 | Warren et al. | 149/19.4 |
| 5,596,168 | * | 1/1997 | Menke et al. | 149/19.4 |
| 5,639,987 | * | 6/1997 | Berteleau et al. | 149/19.8 |
| 5,716,557 | * | 2/1998 | Strauss et al. | 264/3.3 |

OTHER PUBLICATIONS

Larry C. Warren et al. "High Performance Ammonium Nitrate Propellants for Next Generation Survivable Propulsion Systems", Apr. 1995, Presented at : Jannaf Propulsion Development and Charization Subcommittee Meeting.

Larry C. Warren et al. "High Performance Ammonium Nitrate Propellants for Next Generation Survivable Propulsion Systems", 1995.

* cited by examiner

*Primary Examiner*—Charles T. Jordon
*Assistant Examiner*—Glenda L. Sánchez
(74) *Attorney, Agent, or Firm*—Arthur H. Tischer; Freddie M. Bush

(57) ABSTRACT

Environmentally friendly high performance minimum signature propellants have been demonstrated for use in next generation tactical missile applications. Bismuth salicylate and bismuth citrate have each been used in propellant formulations and evaluated for processing, ballistic, mechanical, aging and signature properties. These high performance formulations have potential to replace current formulations used in some fielded tactical systems. The propellant binder network is achieved using energetic nitramine polymers where inert polymers have been the polymer of choice for minimum signature propellants. The significance of this has to do with achieving propellant specific impulses greater than 245 seconds without nitroglycerin being used in the formulation. This improves propellant safety properties during the propellant processing and the manufacturing of the final missile configurations. The Army has mandated that the next generation propellant formulations show improvements in safety to the end users. These formulations are environmentally friendly (no-lead) and do not use nitroglycerin to achieve high performance.

3 Claims, 4 Drawing Sheets

MINIMUM SIGNATURE ISOCYANATE CURED PROPELLANTS CONTAINING BISMUTH COMPOUNDS AS BALLISTIC MODIFIERS

CROSS-REFERENCE TO RELATED APPLICATION

This application is related to concurrently filed application by Inventor: Larry C. Warren; Invention Docket No.: AMPC 4974, and Titled: "A Processing Procedure For Isocyanate Cured Propellants Containing Some Bismuth Compounds."

DEDICATORY CLAUSE

The invention described herein may be manufactured, used and licensed by or for the Government for governmental purposes without the payment to me of any royalties thereon.

BACKGROUND OF INVENTION

The U.S. Army Aviation and Missile Command at Redstone Arsenal has long been interested in the removal of environmental hazards in its tactical missile propellants. Of particular interest is the removal of lead from the exhaust products of all tactical missiles. Lead compounds are currently the major ballistic modifiers used in the traditional minimum signature propellants for tactical missile applications. Lead is currently found in nearly all tactical missiles where minimum signature is required. The toxicity of lead has been well documented and is the incentive behind the Army's desire to remove it from missile systems. However, this task has proven to be difficult, especially when minimum signature and ballistic integrity of the propellant must be maintained. Typically, when an ingredient is found to control ballistic properties, a loss in minimum signature properties has resulted also. This information was disclosed in an earlier presentation by L. C Warren, "Burning Rate Catalysis of Ammonium Nitrate Propellants", presented at the Tri-service propellant Formulators Conference, Edward AFB, August 1990. A later presentation by L. C. Warren et al., "High Performance Ammonium Nitrate Propellants for Next Generation Survivable Propulsion Systems", was presented at 1995 JANNAF PDCS, JPL, Pasadena, Calif. More detailed information is presented in the Information Disclosure Citation filed with this application.

Two bismuth compounds, bismuth salicylate and bismuth citrate, have been evaluated as lead alternatives in a propellant formulation similar in theoretical performance properties of currently fielded propulsion systems. Industrially, bismuth is considered the less toxic of the heavy metals. The MSDS for bismuth compounds, bismuth salicylate and bismuth citrate has been furnished by Shepherd Chemical Company. Some forms of bismuth are less toxic than others. One such compound is bismuth salicylate. Bismuth salicylate is used in some medicines and is the active ingredient in the non-prescription medicine Pepto Bismol®, an oral over the counter medication used for relieving upset stomach problems. Both bismuth salicylate and bismuth citrate are readily available and are inexpensive.

An object of this invention is to provide a propellant formulation with minimum signature and ballistic integrity of high performance.

Another object of this invention is to provide a lead free propellant formulation and a nitroglycerin free propellant formulation, which is environmentally more attractive based on current EPA requirements.

SUMMARY OF INVENTION

A general description of the bismuth compounds used in the evaluations of this invention is set forth in Table A below.

TABLE A

BISMUTH COMPOUNDS EVALUATED

| Supplier | Bismuth Compound | Formula wt. (g) | Density (g/cc) |
|---|---|---|---|
| The Shepherd Chemical Company | Bismuth Salicylate $C_7H_5BiO_4$ | 362 | 2.36 |
| SIGMA Chemical Company | Bismuth Citrate $C_6H_5O_7Bi$ | 398 | 3.46 |

The baseline propellant formulation of this invention is outlined in Table B below.

TABLE B

BASELINE PROPELLANT FORMULATION

| Ingredient | % |
|---|---|
| ORP-2 | 7.00 |
| BTTN | 20.17 |
| TMETN | 8.64 |
| CARBON | 0.50 |
| RDX, 17$\mu$ | 34.36 |
| RDX, 4$\mu$ | 6.24 |
| HMX, 2.75$\mu$ | 17.40 |
| ZrC, 7$\mu$ | 1.50 |
| MNA | 0.50 |
| Bi COMPOUND | 2.00 |
| N100 | 1.69 |

The propellant binder system consists of the energetic nitramine prepolymer(s) ORP-2 or 9DT-NIDA, plasticized with the nitrate esters BTTN and TMETN, and cured with N 100. Without nitroglycerin, an energetic polymer such as ORP-2 or 9DT-NIDA, is needed to enhance propellant performance impulse to greater than 245 seconds. The elimination of NG is proven to be more beneficial for immediate safety considerations than the elimination of lead. ORP-2 and 9DT-NIDA also enhance propellant burning rates and mechanical properties, two great improvement needs for minimum signature propellants.

Initial evaluations centered on determining the effectiveness of various bismuth additives as the sole ballistic modifier (without zirconium carbide stabilizer) in propellant formulations. By themselves neither lead salicylate nor bismuth salicylate will affect significantly minimum signature propellant burning rate properties. However, it was discovered that the addition of zirconium carbide with either ingredient present, resulted in significant enhancement in propellant ballistic properties, in particular lowering propellant burning rate pressure exponent. Bismuth salicylate was equally as effective as lead salicylate or lead citrate in the presence of zirconium carbide for increasing propellant burning rates and reducing burning rate pressure exponent values. Bismuth citrate appeared to be only slightly less efficient than the bismuth salicylate. This could be because the concentration of bismuth in the citrate derivative is less than in the salicylate.

During these evaluations an unexpected influence by carbon on the propellant ballistic properties was observed. In this work two different carbons were used, Thermax and Sterling R. The particle size of the carbon black played a significant role in enhancing propellant burning rates and reducing burning rate exponents. Superior ballistic properties were achieved with Sterling R carbon as opposed to Thermax carbon. The average particle sizes of the Thermax and Sterling R carbons are 270 and 60 nanometers, respectively. A similar phenomenon concerning average particle size of the bismuth compounds was observed. When the average particle size of the bismuth compounds was less than 5 microns, the ballistic properties adequate for tactical missile applications were achieved.

DESCRIPTION OF PREFERRED EMBODIMENT

Figure 1:
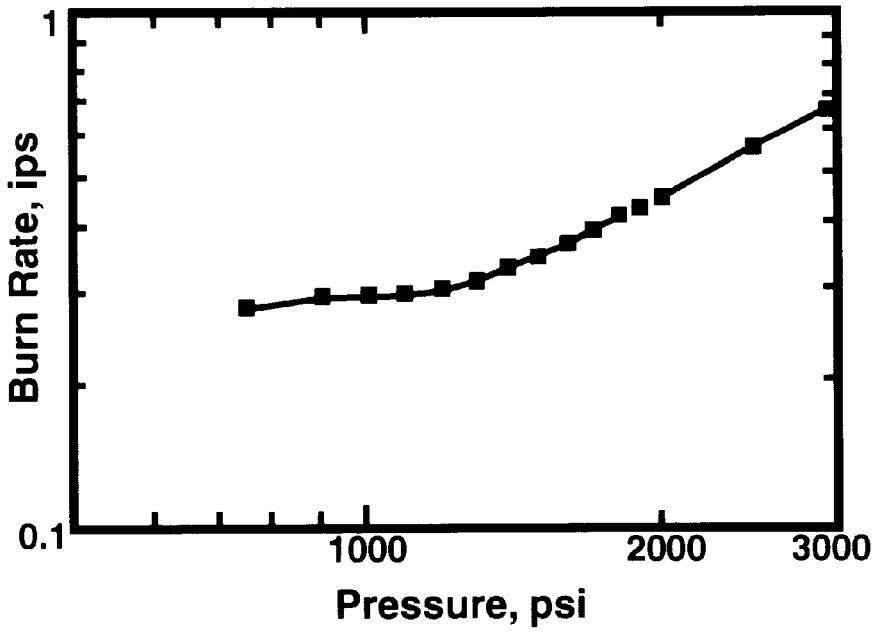
FIG. 1 is a plot of 2% bismuth salicylate and Thermax propellant strand data.

| Ingredient | % | Notes |
|---|---|---|
| polymer | 6.00–7.00 | 1 |
| plasticizers | 28.00–29.00 | 2 |
| carbon black | 0.50–0.60 | 3 |
| nitrocellulose | 0.15–0.25 | 4 |
| oxidizers | 58.00–63.00 | 5 |
| ZrC | 1.00–1.50 | 6 |
| MNA | 0.50–0.75 | 7 |
| Ballistic additive | 2.00–4.00 | 8 |
| N100 | 1.50–1.80 | 9 |

Notes:

1.0 POLYMERS-ORP-2 or 9DT-NIDA are the preferred polymers. The polymer percentage can be as low as six percent for 9DT-NIDA and seven percent for ORP-2. These are the lower limits for good mechanical properties; higher polymer concentrations may reduce propellant performance, but ballistic properties will not vary greatly.

2.0 PLASTICIZERS-A combination of BTTN and TMETN is preferred for performance Isp 245 to 250 seconds. A 70 to 30 percent blend of BTTN and TMETN is preferred with an approximate Pl/Po ratio from 3.3 to 3.7. Desirable properties can be achieved with all nitrate ester plasticizers.

3.0 CARBON BLACK—Sterling R carbon used with ZrC and the bismuth compound gave the best ballistic properties in these evaluations. The significant feature of the Sterling R carbon versus Thermax carbon is a smaller average particle size. Other carbons of the same particle size or smaller may give similar results. The average particle size of Sterling R carbon is 70 nanometers versus 270 nanometers for Thermax. The increased surface area over Thermax carbon stabilizes the combustion of the propellant to achieve the desired burn rate pressure exponent between 1000 and 2000 psi. Typically carbon is added at the half percent (0.5%) level.

4.0 NITROCELLULOSE-Nitrocellulose is used as a crosslinking agent to shore up propellant mechanical properties. An added benefit is a slight improvement in propellant burning rate. Nitrocellulose percent can vary from 0.15–0.25% for improving propellant mechanical properties.

5.0 OXIDIZERS-A combination of RDX and HMX is preferred from 58-63 percent. The particle size distribution of 60%(RDX, 17$\mu$), 30%(HMX, 2.75$\mu$) and 10% (RDX, 4$\mu$) was used for these evaluations. Slight variations in distributions should not change propellant overall results. CL-20 (2,4,6,8,10,12-Hexanitrohexaazaisowurtzitane) (HNIW) can be used for either RDX or HMX and not change overall ballistic properties, significantly. CL-20 would however cause an increase in propellant performance Isp, burning rates and density.

6.0 ZIRCONIUM CARBIDE(ZrC)-ZrC in combination with bismuth and carbon is necessary to achieve desired propellant ballistic properties. The average particle size for these evaluations was 7$\mu$.

7.0 MNA-Typical percent of MNA added is 0.5–0.75%. When propellant is cured at 70 degrees F less MNA is used up during the usual week long curing process at 140 degrees F. Therefore, service life of propellant containing bismuth catalysts should increase significantly.

8.0 BALLISTIC CATALYSTS-Bismuth salicylate or bismuth citrate in combination with ZrC and carbon can be used instead of the lead compounds to achieve desired ballistic properties. The percent can vary from 2–4% of the propellant formulation. The propellant can be cured at ambient without additional cure catalyst for bismuth salicylate. When bismuth citrate is used a cure catalyst such as dibutyltin dilaurate is necessary for ambient cures.

9.0 CURATIVE-The preferred curing agent is triisocyanate (Desmodur N100). Polymer cure ratio can vary from 1.1 to 1.3.

INGREDIENTS DEFINED

Bismuth citrate Salt of citrate acid

Bismuth citrate salt of salicylic acid, also called bismuth subsalicylate

9DT-NIDA energetic nitramine polymer developed by Thiokol under a MICOM contract ORP-2 energetic nitramine polymer, developed by Olin Corporation BTTN butanetriol trinitrate-plasticizer CARBON Thermax (270 nanometers) and Sterling R (75 nanometers) carbon blacks Ballistic-modifiers bismuth compounds-bismuth salicylate and citrate(less than 5 microns)

HMX tetramethylene tetranitramine

Ips inches per second

MNA N-methyl para nitroaniline-chemical aging stabilizer

N100 triisocyanate, curing agent, Desmodur N100

RDX trimethylene trinitramine

Sterling R carbon black rubber grade (particle size 75 nanometers) supplied by Cabot TMETN trimethylolethane trinitrate-plasticizer ZrC zirconium carbide-ballistic stabilizer

PROPELLANT PROCESSING PROPERTIES

Some bismuth compounds are excellent catalysts for the isocyanate cure reaction. When used as a cure catalyst only a very small amount(<0.03%) of the total weight of the formulation is required. However, to be effective as a ballistic additive, concentrations greater than two percent by weight in the propellant formulation appear to be necessary. For maximum dispersion the catalyst is usually added after the addition of the oxidizers at the initial mix temperature of 140° F. When the bismuth salicylate was added at 140° F., the potlife of the propellant was significantly less than one hour. Propellant potlife less than twenty minutes was the norm. Reducing the temperature from 140° F. to 70° F. before adding the bismuth salicylate resulted in an increase in potlife to one to two hours. Propellant Potlife is generally defined as the time it takes for the propellant to reach forty kilopoise after the addition of the curing agent.

However, when the propellant mixture temperature was lowered to 60° F. before the addition of the bismuth salicylate, a potlife greater than ten hours was achieved. This is the process patent application disclosed and claimed in the concurrently filed application referenced hereinabove. It is postulated that when bismuth salicylate is added at 60° F., the rate at which the bismuth ion is formed is reduced significantly. The hydroxyl-isocyanate reaction rate is dramatically affected by the bismuth ion concentration. Therefore, a dramatic increase in propellant potlife is gained. Potlife data of a gallon mix containing bismuth salicylate is shown in Table 10 hereinbelow. The propellant end of mix viscosity was 3.5 kilopoise at 60° F. Higher propellant solids loadings appear possible without adversely affecting propellant castability at this temperature.

The above propellant mixing procedure applies to the use of bismuth salicylate. Bismuth citrate does not accelerate the propellant cure reaction the same as bismuth salicylate. Using the above procedure, dibutyltin dilaurate was necessary for adequate propellant cures with bismuth citrate. Ballistic properties of propellant containing bismuth salicylate are superior to properties of propellants containing bismuth citrate. Because of the processing advantage when using the bismuth citrate, this ingredient shows promise for non-lead containing propellants.

PROPELLANT MECHANICAL PROPERTIES

Typical mechanical properties of the proposed lead-free propellant are shown in Table 11 hereinbelow. Significant work has been done with Orp-2 polymer by this author and others. The propellant properties as reported are typical for Orp-2 in this type formulation. These propellant mechanical properties are superior to reported properties of a currently fielded propellant in ambient stress, strain and modulus. The propellant mechanical property data reported here is not optimized and may vary slightly when 9DT-NIDA is used. Both pre-polymers ORP-2 and 9DT-NIDA can produce propellants with excellent mechanical properties when used with this combination of ingredients.

PROPELLANT COMBUSTION PROPERTIES

Figure 2:
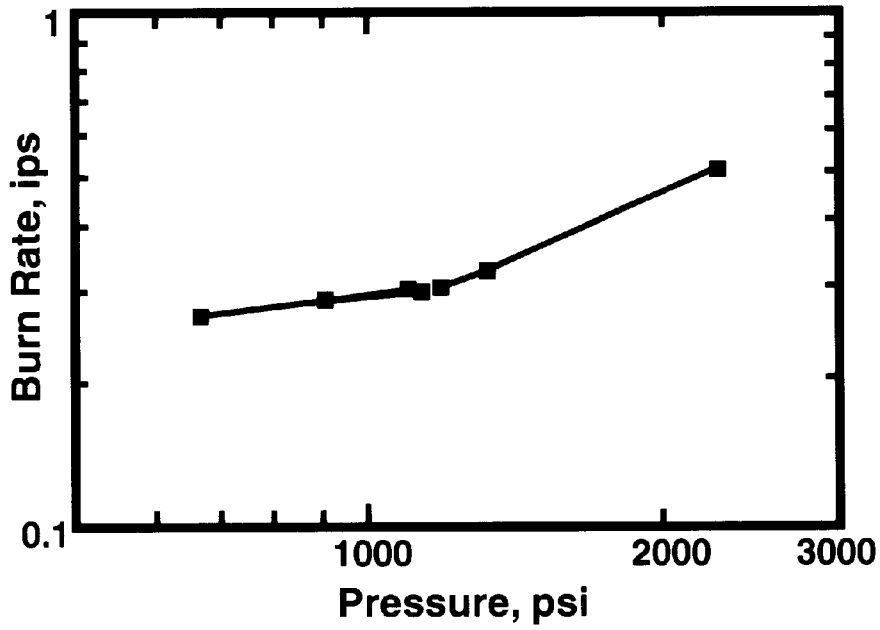
FIG. 2 is a plot of 2% bismuth salicylate and Thermax 2×4 motor data.

The strand burning rate data of the ORP-2 propellant containing bismuth salicylate are shown in Table 1. Thermax carbon was used in the initial evaluations. The propellant burning rate properties are comparable to currently fielded propellants. The strand burning rate data are plotted in FIG. 1. The propellant burning rate curve is relatively flat with an exponent less than 0.3 to 1400 psi. Above 1400 psi the burning rate pressure exponent approaches one. The 2×4 motor burning rate data are shown in Table 2. The 2×4 motor burning rate data are plotted in FIG. 2. The 2×4 motor data curve is similar to the strand data curve with the exponent break appearing at approximately 1400 psi. This is undesirable for tactical missile systems with an MEOP anywhere above 1300 psi. Typically, minimum signature propellant burning rate pressure exponent breaks occur above 2000 psi.

Figure 3:
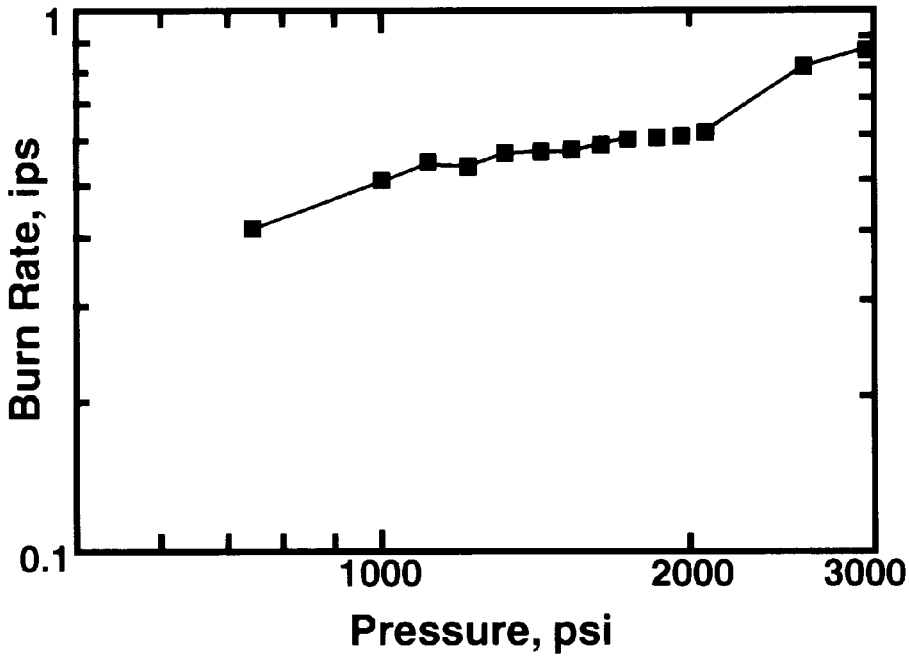
FIG. 3 is a plot of 2% bismuth salicylate and Sterling R propellant strand data.
Figure 4:
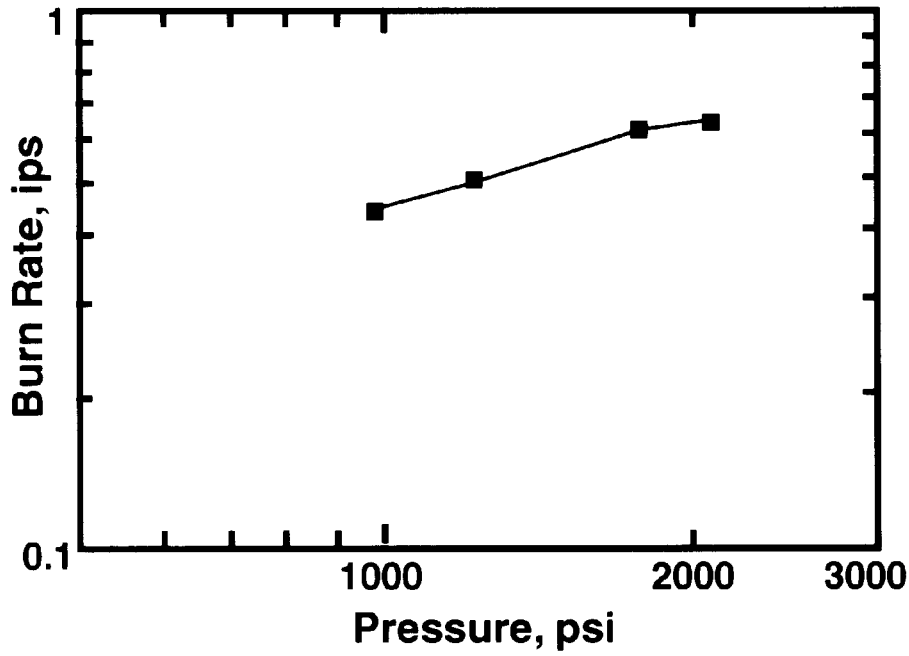
FIG. 4 is a plot of bismuth salicylate and Sterling R propellant 2×4 motor data.

The same propellant formulation was evaluated using the Sterling R carbon. The propellant strand burning rate data are shown in Table 3. The strand burning rate data are plotted in FIG. 3. Sterling R carbon shifted the burning rate pressure exponent break to above 2000 psi in both the strand and 2×4 motor data. The 2×4 motor data using the Sterling R carbon are shown in Table 4. The 2×4 motor data are plotted in FIG. 4. The burning rate pressure exponents for the strand and 2×4 motor data are 0.3 and 0.45, respectively. The 2×4 motor data appears to be the same as for the strands. The burning rates are slightly lower which is normal. The trend appears clear that bismuth salicylate and bismuth citrate in the presence of zirconium carbide and Sterling R carbon result in the desired ballistic properties for tactical missile applications.

TABLE 1

PROPELLANT GALLON MIX STRAND DATA-THERMAX AND BISMUTH SALICYLATE

| PSI | 750 | 900 | 1000 | 1100 | 1200 | 1300 | 1400 | 1500 | 1600 | 1700 | 1800 | 1900 | 2000 | 2500 | 3000 |
|---|---|---|---|---|---|---|---|---|---|---|---|---|---|---|---|
| Rb | .280 | .288 | .290 | .290 | .297 | .309 | .325 | .346 | .364 | .380 | .409 | .417 | .440 | .550 | .660 |

TABLE 2

BISMUTH SALICYLATE AND THERMAX
2 × 4 MOTOR BURN RATE DATA

| Psi | 682 | 914 | 1117 | 1136 | 1151 | 1199 | 1346 | 2305 |
|---|---|---|---|---|---|---|---|---|
| Rb, ips | .260 | .279 | .292 | .291 | .291 | .296 | .318 | .504 |
| Nozzle, in. | .300 | .269 | .247 | .247 | .245 | .241 | .237 | .229 |

TABLE 3

BISMUTH SALICYLATE AND STERLING R PROPELLANT STRAND BURN RATE DATA

| Psi | 750 | 1000 | 1100 | 1200 | 1300 | 1400 | 1500 | 1600 | 1700 | 1800 | 1900 | 2000 | 2500 | 3000 |
|---|---|---|---|---|---|---|---|---|---|---|---|---|---|---|
| Rh | .37 | .46 | .50 | .49 | .52 | .53 | .535 | .54 | .56 | .57 | .57 | .575 | .77 | .85 |

TABLE 4

BISMUTH SALICYLATE AND STERLING R PROPELLANT
2 × 4 BURN RATE DATA

| Pressure, psi | 844 | 1078 | 1624 | 1952 |
|---|---|---|---|---|
| Burn rate, $R_b$, ips | 0.38 | 0.44 | 0.55 | 0.57 |

PRELIMINARY AGING PROPERTIES

Figure 5:
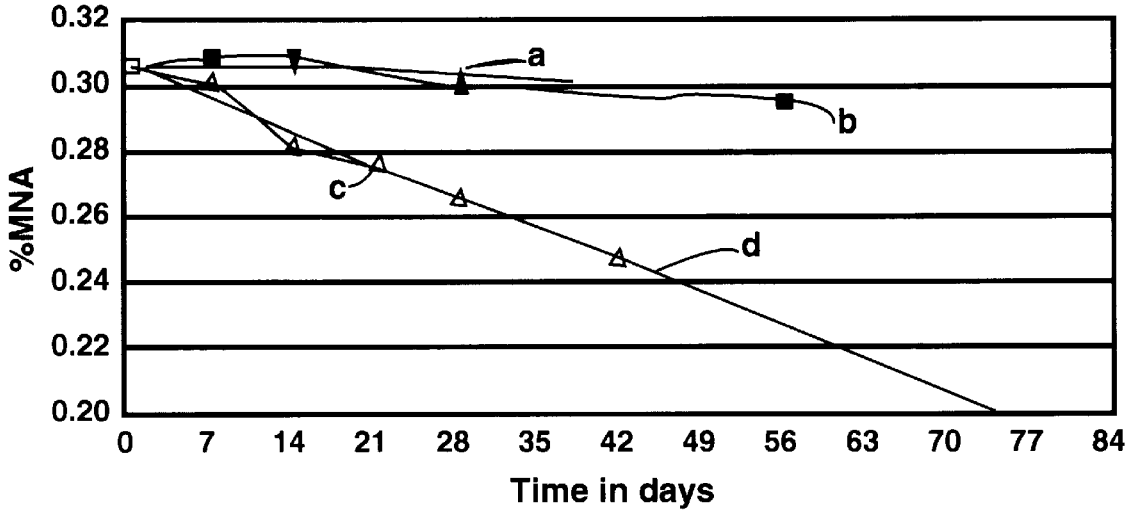
FIG. 5 is a mna depletion graph of a 2% bismuth salicylate propellant.
Figure 6:
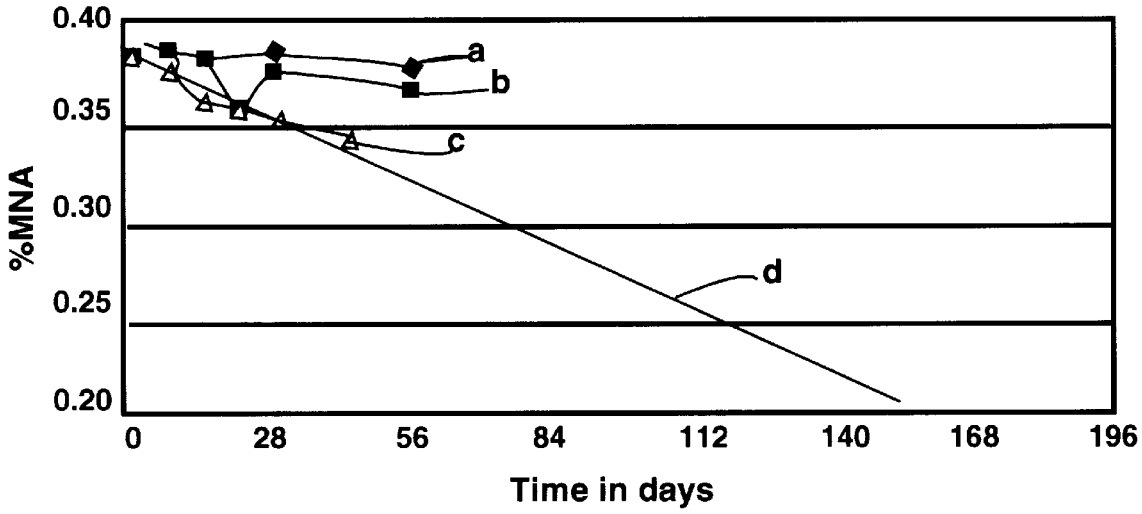
FIG. 6 is a mna depletion graph of a 2% bismuth citrate propellant.

Another critical propellant property is aging, determined by the depletion rate of N-methyl para nitroaniline, MNA. MNA is added to the propellant to scavenge nitrogen dioxide ($NO_2$) released from the nitrate esters BTTN and TMETN. If $NO_2$ accumulation is left unchecked, a loss of propellant mechanical and safety properties is the result. MNA scavenges the $NO_2$ gas to prevent this from occurring. Preliminary results of MNA depletion rates were determined for a propellant containing bismuth salicylate and bismuth citrate as shown in Table 5 and Table 6 below. See FIG. 5 and FIG. 6 for the graphical presentation of the data. Points a, b, c, and d represent MNA @50° C., 60° C., 70° C., and linear MNA @70° C. respectively for FIG. 5 and FIG. 6. The results are excellent. From these findings neither the bismuth salicylate or citrate accelerate the decomposition of the nitrate esters significantly. The results were comparable to previous data of propellants containing lead compounds and the results are comparable.

TABLE 5

MNA Depletion for 2% Bismuth Citrate Propellant

| % MNA | Times in Days | Temperature |
|---|---|---|
| 0.31 | 28 | 50 |
| 0.30 | 28 | 60 |
| 0.28 | 14 | 70 |
| 0.26 | 28 | 70 |
| 0.25 | 42 | 70 |

TABLE 6

MNA Depletion for 2% Bismuth Salicylate Propellant

| % MNA | Times in Days | Temperature |
|---|---|---|
| 0.38 | 28 | 50 |
| 0.37 | 28 | 60 |
| 0.35 | 28 | 70 |
| 0.34 | 42 | 70 |

EVALUATION OF 9DT-NIDA POLYMER

Figure 7:
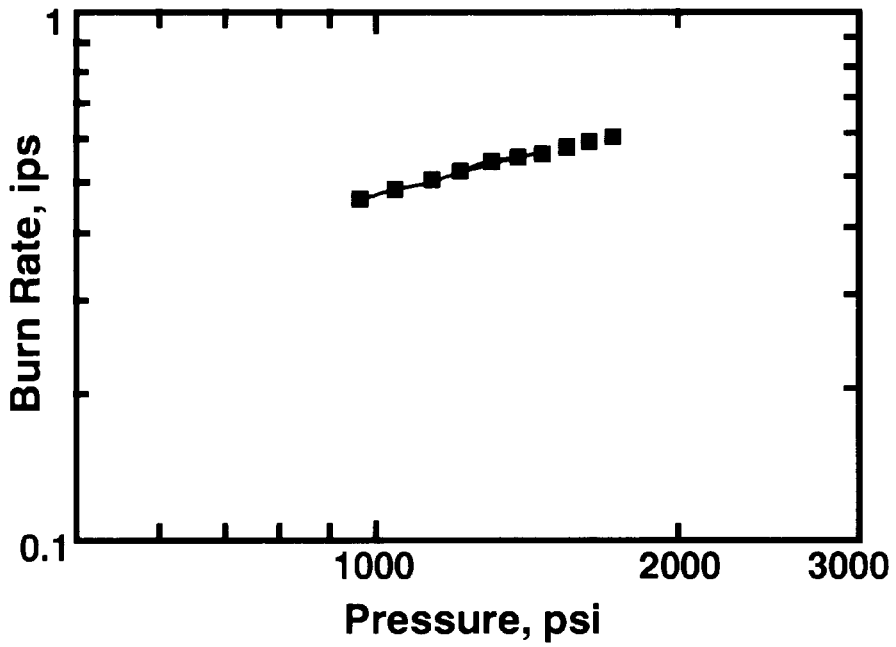
FIG. 7 is a plot of 9dt-nida propellant strand data.
Figure 8:
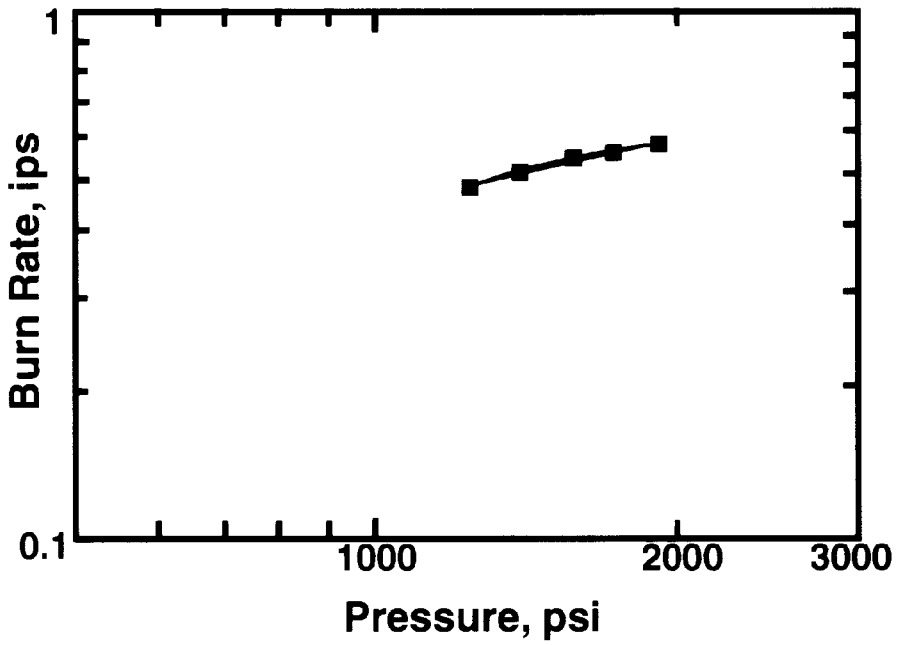
FIG. 8 is a plot of 9dt-nida propellant 2×4 motor burn rate data with burn rate pressure exponent of 0.4.

9DT-NIDA, like ORP-2 is a nitramine polymer. Both give similar properties when used in the formulation as described previously for evaluating ORP-2. The propellant performance, ballistic, processing, mechanical, signature and aging properties are very similar. The 9DT-NIDA propellant bum rate data are outlined in Table 7 and Table 8. Data plots are shown in FIG. 7and FIG. 8. Propellant burning rates and rate exponent values are close to the same as those reported for ORP-2 propellant. Ballistic properties are also adequate for tactical missile applications. Other 9DT-NIDA propellant properties such as mechanical, aging and signature are expected to be the near the same or better than with ORP-2 polymer.

TABLE 7

PROPELLANT GALLON MIX STRAND DATA-9DT-NIDA/STERLING R/BISMUTH SALICYLATE/ZrC

| PSI | 1000 | 1100 | 1200 | 1300 | 1400 | 1500 | 1600 | 1700 | 1800 | 1900 | 2000 |
|---|---|---|---|---|---|---|---|---|---|---|---|
| Rb | 0.40 | 0.42 | 0.44 | 0.46 | 0.48 | 0.49 | 0.50 | 0.51 | 0.52 | 0.53 | 0.64 |

TABLE 8

PROPELLANT GALLON MIX 2 × 4 MOTOR DATA-9DT-NIDA/STERLING R/BISMUTH SALICYLATE/Zrc

| PSI | 1161 | 1317 | 1516 | 1671 | 1865 |
|---|---|---|---|---|---|
| Rb, ips | 0.42 | 0.45 | 0.48 | 0.49 | 0.51 |

PRELIMINARY SIGNATURE EVALUATION

The propellant formulation evaluated for signature contained two percent bismuth salicylate, and one and one half percent zirconium carbide. These two ingredients are expected to produce smoke during the combustion process. Four 2×2 motors were fired in the Propulsion Laboratory's smoke chamber facility. The average transmittances in the photopic and infrared regions are ninety four and ninety eight percent, respectively. Transmittance greater than 90 percent is considered passing for minimum signature classification. The data summary of the four 2×2 motors fired in the smoke chamber facility is shown in Table 9.

TABLE 9

BISMUTH SALICYLATE PROPELLANT SIGNATURE DATA

| Test # | 1 | 2 | 3 | 4 | Average |
|---|---|---|---|---|---|
| Photopic, % T | 96 | 91 | 95 | 93 | 94 |
| Infrared, % T | 100 | 95 | 99 | 99 | 98 |

TABLE 10

GALLON MIX POTLIFE DATA OF BISMUTH SALICYLATE PROPELLANT

| Time, hrs | 0 | 1 | 3 | 4 | >18 |
|---|---|---|---|---|---|
| Viscosity, Kp (amb.) | 3.5 | 3.0 | 4.5 | 4.5 | firm |

TABLE 11

MECHANICAL PROPERTY DATA OF TYPICAL ORP-2 PROPELLANT

| Temperature ° F. | Stress Psi | Strain % | Modulus Psi | Corrected Stress Psi |
|---|---|---|---|---|
| 140 | 38 | 220 | 111 | 109 |
| 75 | 66 | 271 | 169 | 245 |
| −40 | 650 | 34 | 4667 | 1108 |

The advantages of environmentally friendly high performance lead-free propellant formulations using bismuth citrate or bismuth salicylate as replacements for lead citrate or lead salicylate are recognized. Both bismuth compounds are readily available and are inexpensive. The optimum concentrations of the bismuth compounds are the same as for lead compounds; therefore propellant performance levels are not adversely affected. When using bismuth salicylate or bismuth citrate ambient cures are possible eliminating the need for expensive ovens to cure propellants at 140 degrees F. Ambient propellant cures will eliminate a safety hazard during the propellant curing process, and will increase propellant service life. Both processes could result in substantial cost savings to the Army over the long term.

I claim:

1. A lead free and a nitroglycerin free propellant formulation based on eliminating lead containing and nitroglycerin containing compositions from said formulation to achieve an environmentally more attractive propellant formulation based on current environmental protection agency requirements, said lead free and nitroglycerin free propellant formulation comprising in weight percent amounts of ingredients as follows:

i. an energetic nitramine polymer from about 6.00 to about 7.00;

ii. a plasticizer selected from nitrate ester plasticizers from about 28.00 to about 29.00;

iii. carbon black of particle size range from about 70 nanometers to about 270 nanometers from about 0.50 to about 0.60;

iv. nitrocellulose as a crosslinking agent for improving mechanical properties from about 0.15 to about 0.25;

v. a blended oxidizer of tetramethylene tetranitramine (RDX) and trimethylene trinitramine (HMX) from about 58.00 to about 63.00, said blended oxidizer having particle size and weight percent amounts in said blended oxidizer as follows: 60 weight percent of 17 micrometer particle size of said RDX and 10 weight percent of 4 micrometer particle size of said RDX and 30 weight percent of 2.75 micrometer particle size of said HMX;

vi. zirconium carbide of about 7 micrometer particle size from about 1.00 to about 1.50;

vii. N-methyl para nitroaniline, as a chemical aging stabilizer from about 0.50 to about 0.75;

viii. a ballistic additive selected from bismuth salicylate and bismuth citrate from about 2.00 to about 4.00 with an added trace amount of a cure catalyst of dibutyltin dilaurate when said bismuth citrate is selected; and, ix. A triisocyanate curing agent from about 1.50 to about 1.80.

2. The lead free and nitroglycerin free propellant formulation as defined in claim 1 wherein said energetic nitramine polymer is present in weight percent amount of 7.00; wherein said plasticizer is comprised of butanetriol trinitrate which is present in weight percent amount of 20.17 and trimethylolethane trinitrate which is present in weight percent amount of 8.64; wherein said carbon black of particle size of 70 nanometers is present in weight percent amount of 0.50; wherein said blended oxidizer is comprised of tetramethylene tetranitramine of particle size 17 micrometers is present in weight percent amount of 34.36, tetramethylene tetranitramine of particle size 4 micrometers is present in weight percent amount of 6.24, and trimethylene trinitramine of particle size 2.75 micrometers is present in weight percent amount of 17.40; wherein said zirconium carbide of particle size of 7 micrometers is present in weight percent amount of 1.50;

wherein said N-methyl para nitroaniline is present in weight percent amount of 0.50;

wherein said ballistic additive is bismuth salicylate which is present in weight percent amount of 2.00; and wherein said triisocyanate curing agent is present in weight percent amount of 1.69.

3. The lead free and nitroglycerin free propellant formulation as defined in claim 1 wherein said energetic nitramine polymer is present in weight percent amount of 7.00; wherein said plasticizer is comprised of butanetriol trinitrate which is present in weight percent amount of 20.17 and trimethylolethane trinitrate which is present in weight percent amount of 8.64; wherein said carbon black of particle size of 270 nanometers is present in weight percent amount of 0.60; wherein said blended oxidizer is comprised of tetrarnethylene tetranitramine of particle size 17 micrometers is present in weight percent amount of 34.36, tetramethylene tetranitramine of particle size 4 micrometers is present in weight percent amount of 6.24, and trimethylene trinitramine of particle size 2.75 micrometers is present in weight percent amount of 17.40; wherein said zirconium carbide of particle size of 7 micrometers is present in weight percent amount of 1.50;

wherein said N-methyl para nitroaniline is present in weight percent amount of 0.50;

wherein said ballistic additive is bismuth citrate which is present in weight percent amount of 2.00 plus a trace amount of a cure catalyst of dibutyltin dilaurate; and wherein said triisocyanate curing agent is present in weight percent amount of 1.69.

* * * * *